United States Patent [19]

Mack et al.

[11] 4,208,979

[45] Jun. 24, 1980

[54] PONTOON SPUDWELL SYSTEM

[75] Inventors: Kit L. Mack, Camarillo; Clifford I. Skaalen, Oxnard, both of Calif.

[73] Assignee: The United States of America as represented by the Secretary of the Navy, Washington, D.C.

[21] Appl. No.: 916,412

[22] Filed: Jun. 16, 1978

[51] Int. Cl.[2] ..... B63B 35/44

[52] U.S. Cl. ..... 114/264; 405/196

[58] Field of Search ..... 114/263-267, 114/122, 213, 205, 214, 215, 270, 219, 220; 405/195, 196, 200, 202, 203, 218, 219, 220, 221, 224, 227; 14/2.6, 7, 8, 27, 28, 75, 76; 267/63, 153; 254/172

[56] References Cited

U.S. PATENT DOCUMENTS

| | | | |
|---|---|---|---|
| 2,743,102 | 4/1956 | Seddon et al. | 267/63 R |
| 3,057,315 | 10/1962 | Robishaw | 114/266 |
| 3,648,998 | 3/1972 | Van der Gag | 267/60 |

FOREIGN PATENT DOCUMENTS

| | | | |
|---|---|---|---|
| 598528 | 5/1960 | Canada | 405/221 |

*Primary Examiner*—Trygve M. Blix
*Assistant Examiner*—Jesús D. Sotelo
*Attorney, Agent, or Firm*—Richard S. Sciascia; Joseph M. St.Amand; Darrell E. Hollis

[57] ABSTRACT

A spudwell cooperating with a pipe pile and a jacking mechanism for elevating a pontoon section above a body of water. The spudwell straddles the pipe pile through a pair of vertically aligned apertures through which the pipe pile extends. A plurality of pins rigidly affixed to the spudwell are aligned to extend through holes located in the pontoon section. When extended through the holes in the pontoon section, a securing plate engages the pins thereby securing the spudwell to the pontoon section. A pair of chains from the jacking mechanism are connected to the spudwell via a motion compensation system incorporated therein.

15 Claims, 6 Drawing Figures

PONTOON SPUDWELL SYSTEM

BACKGROUND OF THE INVENTION

1. Field of the Invention

The present invention relates generally to spudwells and more particularly to detachable spudwell systems employing motion compensation 2. Description of the Prior Art There exists a need within the military for a portable causeway or pier extending outwards from the shore to a point beyond the surf zone. Such portable causeway systems are primarily used for the purpose of transporting logistics ashore from ships. In the past, floating piers have been utilized to perform this function. However, floating piers are susceptible to damage from the surf environment especially in the case of storm-induced waves. In addition, lifting cargo from literage along side a floating pier utilizing a crane mounted on the floating pier is hazardous due to the relative motion between the crane and literage.

SUMMARY OF THE INVENTION

The present invention overcomes the disadvantages and limitations of the prior art by providing an external spudwell configured for external mounting to the causeway pontoon section. The present invention includes a spudwell cooperating with a pipe pile and a jacking mechanism for elevating a pontoon above a body of water. The spudwell straddles the pipe pile through a pair of vertically aligned apertures through which the pipe pile extends. A plurality of pins rigidly affixed to the spudwell are aligned to extend through holes located in the pontoon section. When extended through the holes in the pontoon section, a securing plate engages the pins thereby securing the spudwell to the pontoon section. The jacking mechanism mounted atop the pipe piling is attached to the spudwell through a chain and gimbal system pivotably mounted to a pair of motion compensators which are mounted within the spudwell. Once the chains are secured to the spudwell to the jacking mechanism is actuated thereby lifting the pontoon section upwards out of the water.

It is therefore an object of the present invention to provide an improved spudwell.

It is also an object of the present invention to provide an external spudwell that is easily secured to a barge or causeway pontoon.

Another object of the present invention is to provide a spudwell having a motion compensation system incorporated therein.

Other objects and a more complete appreciation of the present invention and its many intended advantages will develop as the same becomes better understood by reference to the following detailed description when considered in connection with the accompanied drawings in which like reference numerals designate like parts throughout the figures thereof and wherein.

DETAILED DESCRIPTION OF THE PREFERRED EMBODIMENTS

Figures 1, 6:
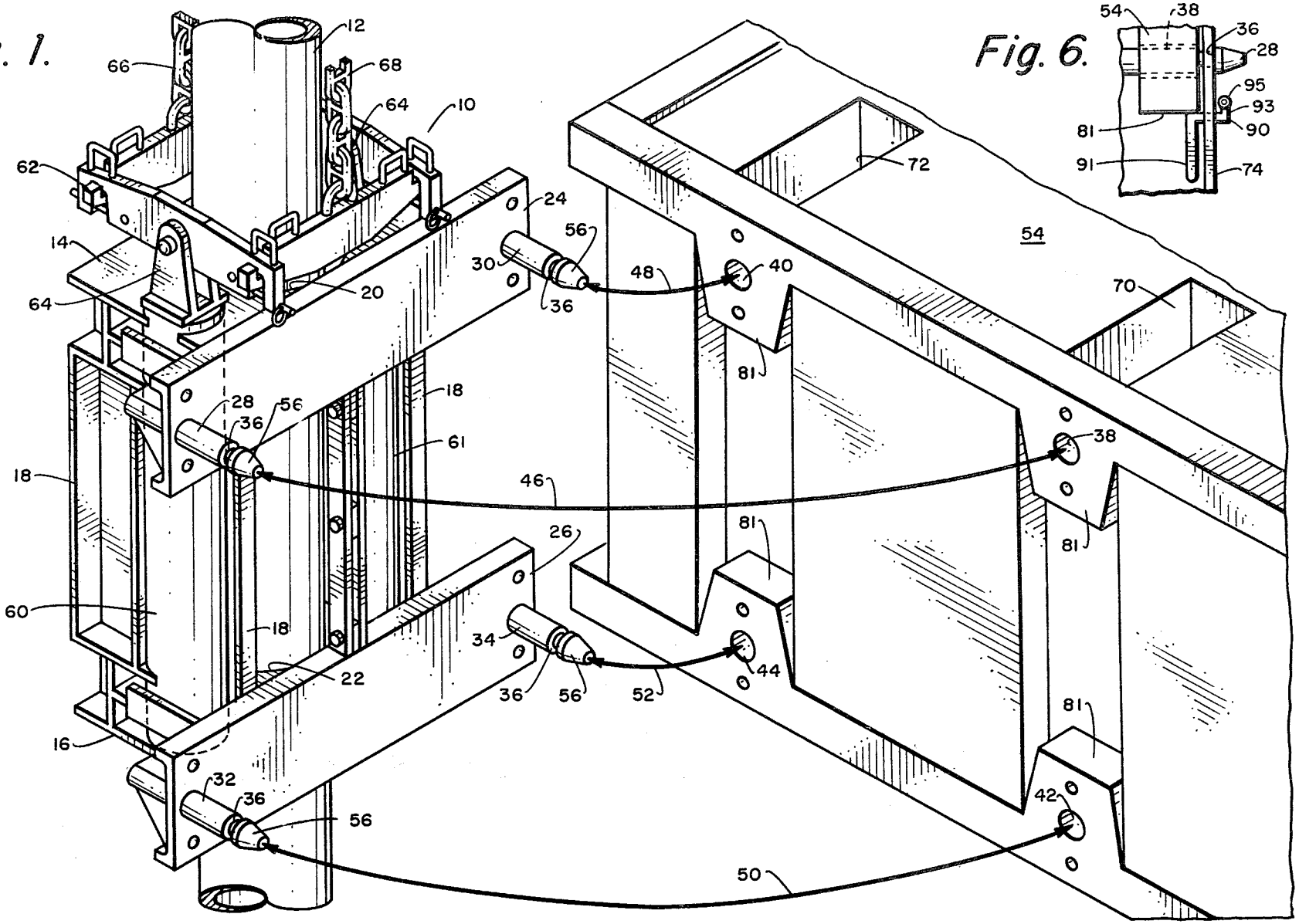
FIG. 1 is an isometric view illustrating the preferred embodiment of the invention.
FIG. 6 is a side view of securing plate 74 illustrating gravity steel lock 90.

Turning to FIG. 1 spudwell 10 is illustrated. Spudwell 10 includes a top plate 14 and a bottom plate 16 rigidly connected by rigid structural members 18 and motion compensator housing 85 such that aperture 20 provided in top plate 14 and aperture 22 provided in bottom plate 16 are vertically alligned with pipe piling 12 extending therethrough. Apertures 20 and 22 are substantially circular in shape having diameters larger than the outside diameter of pipe piling 12 rendering spudwell 10 moveable with respect to pipe piling 12.

A pair of pin support plates 24 and 26 are rigidly affixed to rigid structural members 18 and top plate 14 and bottom plate 16, respectively. A pair of pins 28 and 30 extend outwards and are rigidly affixed to support plate 24 while a pair of pins 32 and 34 extend outwards from and are rigidly attached to lower pin support plate 26. Each pin 28 through 34 is provided with a cone shaped section 56 as well as a circumferential groove 36.

Pins 28, 30, 32 and 34 are aligned to enter openings 38, 40, 42 and 44, respectively, as indicated by arrows 46, 48, 50 and 52, respectively, in FIG. 1. Openings 38 through 44 are contained in causeway pontoon section 54.

Top plate 14, bottom plate 16, structural members 18 and support plates 24 and 26 comprise a guide structure.

A pair of motion compensators 60 and 61 are pivotably connected to gimbal system 62 by means of padeyes 64. Motion compensators 60 and 61 are located on diametrically opposite sides of apertures 20 and 22.

Chains 66 and 68 are attached to the gimbal system 62 at points diametrically opposite each other, with the points of attachment being ninety degrees removed for the points where motion compensators 60 and 61 are attached so that the gimbal system 62 may pivot on the axis between the padeyes 64 in response to force on the chains. Chains 66 amd 68 are connected to a jacking mechanism not shown mounted atop pipe piling 12.

Figure 2:
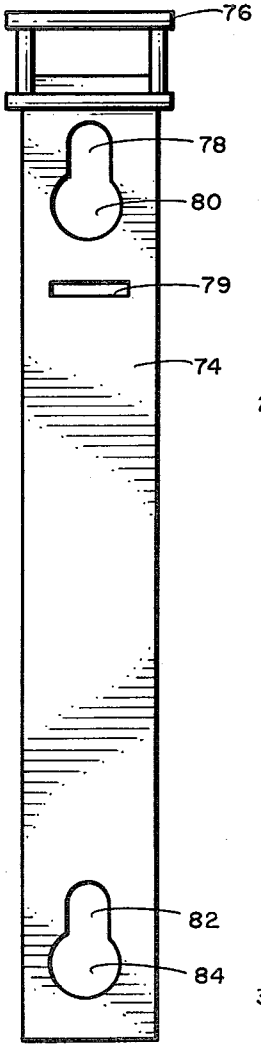
FIG. 2 is a front view of one securing plate utilized to interlock with the circumferential grooves of the pins in the embodiment illustrated in FIG. 1.

Causeway pontoon section 54 is provided with a pair of apertures 70 and 72 therein through which securing plate 74 illustrated in FIG. 2 may be inserted to engage pins 28 through 34 in circumferential grooves 36.

Figure 3:
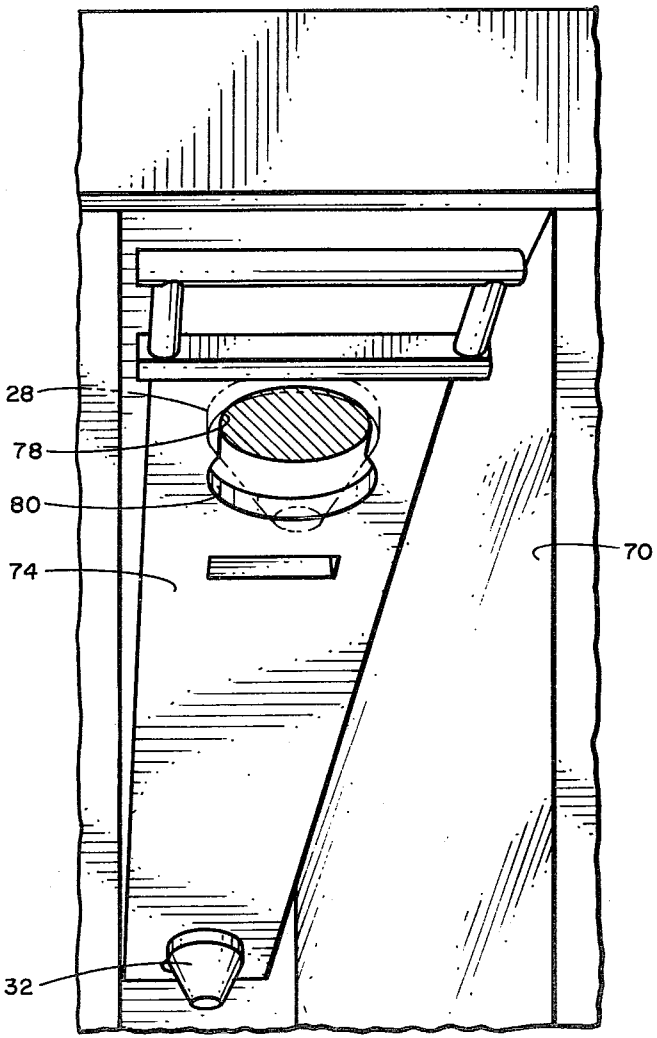
FIG. 3 is a top view illustrating the operation of the securing plate shown in FIG. 2.

Securing plate 74 includes a handle 76 rigidly attached to one end thereof for manually manipulating the same. Securing plate 74 is provided with apertures 78 through 84. Apertures 80 and 84 are suitably dimensioned to permit pins 28 through 34 to project therethrough while apertures 78 and 82 are suitably dimensioned to engage circumferential groove 36 as illustrated in FIG. 3. Aperture 79 is provided for engagement with gravity steel lock 90 which prevents securing plate 74 from moving out of engagement with circumferential groove 36 of pins 28–34. Lock 90 bears on surface 81 of causeway 54. It is noted that each plate 74 includes an aperture 79 for insertion of a lock 90. Segment 91 is heavier than segment 93 of lock 90 thereby biasing lock 90 in the position shown in FIG. 6. A ring 95 is provided to facilitate handling of lock 90. FIG. 3 is a top view of aperture 70 in causeway pontoon section 54 illustrating the engagement of securing plate 74 with circumferential groove 36 of pins 28 through 34. It is noted that a separate securing plate 74 containing only two apertures may be utilized for engaging a single pin.

Operationally, spudwell 10 is secured to causeway pontoon section 54 as follows. Securing plates 74 are inserted in aperture 70 and 74 of pontoon section 54 such that apertures 80 and 84 are aligned with respective openings 38–44. Pins 28 through 34 are positioned to protrude through respective openings 38 through 44 and apertures 80 and 84 such that circumferential grooves 36 are disposed rearward of openings 38 through 44 and apertures 80 and 84. Securing plate 74 is then pushed downward with apertures 78 and 82 engaging circumferential grooves 36 of pins 28 and 32 thereby securing spudwell 10 to causeway pontoon section 54.

To dismount spudwell 10 from pontoon causeway section 54 securing plate 74 is moved upwards such that apertures 78 and 82 are disengaged from circumferential grooves 36 of pins 28 and 32. Spudwell 10 may now be withdrawn from openings 38 through 42 and apertures 80 and 84.

A similar securing plate 74 is inserted through aperture 72 to engage pins 30 and 34.

Figure 4:
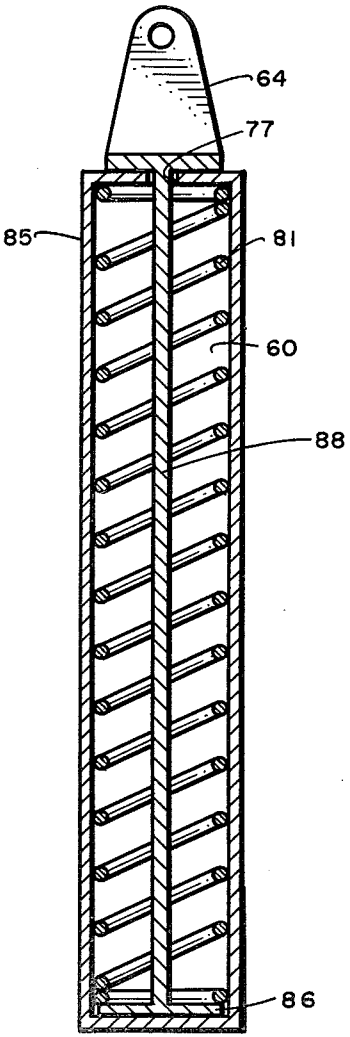
FIG. 4 is a cross-sectional view of a motion compensator utilized in the embodiment shown in FIG. 1.

Motion compensators 60 and 61 are utilized to dampen the large forces imparted to chains 66 and 68 by causeway pontoon section 54 during that time period in which causeway pontoon section 54 is subjected to wave forces from the surf. FIG. 4 illustrates a motion compensator having a spring 81 disposed therein as the active element or dampening element. One end of spring 81 engages motion compensator housing of tube 85 which is rigidly attached to top plate 14 and bottom plate 16 of spudwell 10. The other end of spring 81 engages the flange section 86 which is rigidly affixed to padeye 64 via connecting rod 88 extending through compenssator housing opening 77.

Figure 5:
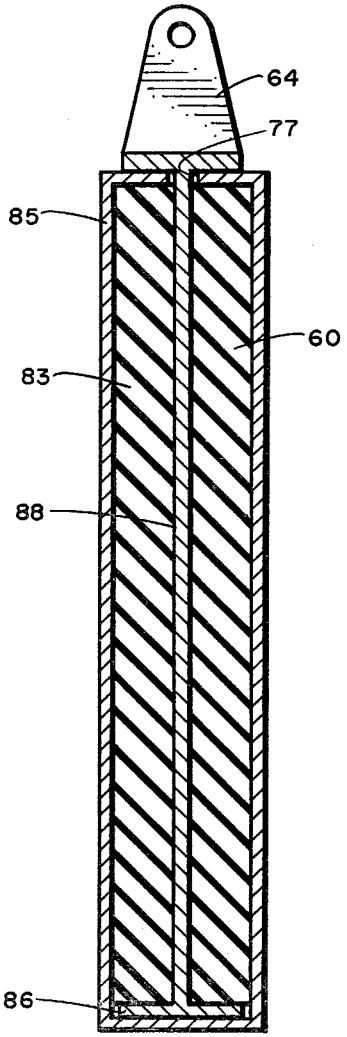
FIG. 5 is an alternative motion compensation system utilized in the embodiment shown in FIG. 1.

In FIG. 5 spring 81 has been replaced by a resilient material 83 as the damping or active element in motion compensator 60. Resilient material 83 may include rubber.

Therefore, may modifications and embodiments of the specific invention will readily come to mind to one skilled in the art having the benefit of the teachings presented in the foregoing invention and hence it is to be understood that the invention is not limited thereto and that such modifications, etc., are intended to be included within the scope of the appended claims.

What is claimed is:

1. A spudwell cooperating with a pipe pile and jacking means disposed for elevating a pontoon above a body of water comprising:

a. a guide structure having a pair of vertically aligned apertures therein through which said pipe pile extends;

b. means for removeably mounting said guide structure on said pontoon; and c. motion compensation means including:

a housing rigidly affixed to said guide structure;

resilient energy absorbing means disposed in said housing; and a load member having one end coupled to said jacking means and engaging said energy absorbing means, said energy absorbing means being compressed by said load member within said housing by upward forces on said load member from said jacking means or downward forces on said housing, whereby said energy absorbing means reduces shock loads on said jacking means due to wave action.

2. The apparatus of claim 1 wherein said guide structure includes:

a. a top plate member having an aperture therein;

b. a bottom plate member having an aperture therein; and c. a plurality of rigid structural members rigidly connected between said top and bottom plate members such that said apertures are vertically aligned.

3. The apparatus of claim 1 wherein said mounting means comprises:

a. a plurality of pins rigidly attached to said guide structure, said pins being positioned to protrude through respective pin apertures on said pontoon; and b. means configured to engage said protruding pins for securing said guide structure to said pontoon.

4. The apparatus of claim 3 wherein each said pin includes a circumferential groove therein.

5. The apparatus of claim 4 wherein said means configured to engage said protruding pins includes plate means having a plurality of first and second apertures, a first aperture and a second aperture being associated with each of said plurality of pins, the first aperture being suitably dimensioned to permit the associated pin to project therethrough and the second aperture being suitably dimensioned to permit engagement of said plate means with said circumferential grooves.

6. The apparatus of claim 5 wherein said plurality of pins includes four pins.

7. A spudwell as recited in claim 1 wherein said resilient energy absorbing means comprises a spring.

8. A spudwell as recited in claim 1 wherein said resilient energy absorbing means comprises a rubber piston.

9. A spudwell as recited in claim 1 wherein said housing is a tubular housing and said energy absorbing means is a helical spring.

10. A spudwell as recited in claim 1 wherein said housing is a tubular housing and said energy absorbing means is a cylindrical rubber piston.

11. The apparatus of claim 1 wherein said load member includes a padeye for coupling to said jack means.

12. A spudwell cooperating with a pipe pile and jacking means disposed for elevating a pontoon above a body of water comprising:

a. a guide structure having a pair of vertically aligned apertures therein through which said pipe pile extends;

b. means for removeably mounting said guide structure on said pontoon; and c. motion compensation means including:

a pair of tubular housings rigidly affixed to said guide structure, said housings being oriented substantially parallel to said pipe pile and having a central aperture in the upper end, said housings being disposed on diametrically opposite sides of said pipe pile;

resilient energy absorbing means having a longitudinal channel disposed in each said housing;

a load member disposed in each said housing, said load member having a flange section engaging the base of said energy absorbing means coupled to a connecting rod section disposed in said longitudinal channel and passing out of said housing through said central aperture, said connecting rod section being coupled to said jack means, said energy absorbing means being compressed by said flange section within said housing by upward forces in said load member from said jacking means or downward forces on said housing, whereby said energy absorbing means reduces shock loads on said jacking means.

13. The apparatus of claim 12 wherein said energy absorbing means includes a spring.

14. The apparatus of claim 12 wherein said energy absorbing means includes a rubber piston.

15. The apparatus of claim 12 further comprising gimbal system pivotably coupled to said connecting rod sections of said load members, said gimbal system being further coupled to linking means at points ninety degrees from the points of coupling to said connecting rod sections, said linking means being coupled to said chain jack.

* * * * *